US010590699B2

(12) United States Patent
Chen

(10) Patent No.: US 10,590,699 B2
(45) Date of Patent: Mar. 17, 2020

(54) CORDLESS ROLLER SHADE

(71) Applicant: My Home Global Company, ErShui Township, ChangHua County (TW)

(72) Inventor: Ju-Huai Chen, ErShui Township (TW)

(73) Assignee: MY HOME GLOBAL COMPANY, Changhua County (TW)

( * ) Notice: Subject to any disclaimer, the term of this patent is extended or adjusted under 35 U.S.C. 154(b) by 211 days.

(21) Appl. No.: 15/721,991

(22) Filed: Oct. 2, 2017

(65) Prior Publication Data

US 2019/0100960 A1 Apr. 4, 2019

(51) Int. Cl.

| | |
|---|---|
| ***E06B 9/42*** | (2006.01) |
| ***E06B 9/34*** | (2006.01) |
| ***E06B 9/322*** | (2006.01) |
| ***E06B 9/60*** | (2006.01) |
| *E06B 9/28* | (2006.01) |

(52) U.S. Cl.

CPC ..... *E06B 9/34* (2013.01); *E06B 9/322* (2013.01); *E06B 9/42* (2013.01); *E06B 9/60* (2013.01); *E06B 2009/285* (2013.01); *E06B 2009/3222* (2013.01); *E06B 2009/425* (2013.01)

(58) Field of Classification Search

CPC ..... E06B 9/34; E06B 9/40; E06B 9/50; E06B 9/56; E06B 9/60; E06B 9/62; E06B 9/322; E06B 9/42; E06B 2009/425; E06B 2009/3222

See application file for complete search history.

(56) References Cited

U.S. PATENT DOCUMENTS

| | | | | | |
|---|---|---|---|---|---|
| 1,149,993 | A * | 8/1915 | Bundy et al. | E06B 9/50 | 160/294 |
| 1,739,203 | A * | 12/1929 | Axe | E06B 9/44 | 464/184 |
| 2,211,982 | A * | 8/1940 | O'Malley | E06B 9/78 | 160/384 |
| 2,307,095 | A * | 1/1943 | Zaferakis | E06B 9/60 | 160/263 |
| 2,599,121 | A * | 6/1952 | Miller, Jr. | E06B 9/78 | 160/384 |
| 3,362,053 | A * | 1/1968 | Land | E06B 9/78 | 16/422 |

(Continued)

FOREIGN PATENT DOCUMENTS

| | | | | |
|---|---|---|---|---|
| EP | 2907963 A1 * | 8/2015 | ..... | E06B 9/42 |
| FR | 3069569 A3 * | 2/2019 | ..... | E06B 9/50 |

*Primary Examiner* — Johnnie A. Shablack

(74) *Attorney, Agent, or Firm* — Alan D. Kamrath; Mayer & Williams PC

(57) ABSTRACT

A cordless roller shade includes a head unit (1), a shading face (2) mounted on the head unit, an elastic dynamic device (13) mounted on the head unit, and a bottom unit (3) mounted on the shading face. The elastic dynamic device includes a spring (133) having a thickness ranged between 0.1 mm and 0.2 mm. The bottom unit includes at least one balance member (33) having a determined weight ranged between 0.1 kg and 1.2 kg, and the shading face and the bottom unit have a total weight ranged between 1 kg and 5 kg, to balance the torque of the spring of the elastic dynamic device, so that the shading face is moved by the bottom unit to a determined position and is located at the determined position.

14 Claims, 12 Drawing Sheets

(56) References Cited

U.S. PATENT DOCUMENTS 3,484,910 A * 12/1969 Gossling ..... E06B 9/78 16/422
4,399,857 A * 8/1983 Honnna ..... E06B 9/50 160/323.1
4,452,294 A * 6/1984 Fukuchi ..... A47H 23/01 160/384
6,029,734 A * 2/2000 Wang ..... E06B 9/322 160/170
6,056,036 A * 5/2000 Todd ..... E06B 9/262 160/84.01
6,412,537 B1 * 7/2002 Voss ..... E06B 9/322 160/168.1 R
6,575,223 B1 * 6/2003 Chung ..... E06B 9/32 160/170
7,315,681 B2 * 1/2008 Kewitsch ..... G02B 6/4457 385/135
7,740,047 B2 * 6/2010 Koop ..... E06B 9/50 160/323.1
8,251,120 B2 * 8/2012 Chen ..... E06B 9/42 160/314
8,307,879 B2 * 11/2012 Lin ..... E06B 9/60 160/313
8,708,024 B2 * 4/2014 Toti ..... E06B 9/322 160/170
9,115,533 B2 * 8/2015 Ng ..... E06B 9/42
9,328,554 B2 * 5/2016 Toti ..... E06B 9/322
9,376,861 B2 * 6/2016 Lin ..... E06B 9/42
9,587,429 B2 * 3/2017 Cheng ..... E06B 9/40
9,631,422 B1 * 4/2017 Chen ..... E06B 9/42
9,719,297 B1 * 8/2017 Chen ..... E06B 9/34
9,765,566 B1 * 9/2017 Chen ..... E06B 9/42
9,850,704 B2 * 12/2017 Jang ..... E06B 9/34
9,957,752 B2 * 5/2018 Bohlen ..... E06B 9/42
9,976,346 B2 * 5/2018 Ng ..... E06B 9/42
10,113,359 B1 * 10/2018 Chen ..... E06B 9/56
10,393,206 B2 * 8/2019 Chen ..... E06B 9/42
2008/0035281 A1 * 2/2008 Kirby ..... E06B 9/42 160/265
2009/0283226 A1 * 11/2009 Cheng ..... E06B 9/60 160/313
2011/0036516 A1 * 2/2011 Cheng ..... E06B 9/60 160/311
2013/0087415 A1 * 4/2013 Hsieh ..... E06B 9/322 185/37
2014/0069595 A1 * 3/2014 Chen ..... E06B 9/72 160/291
2014/0157547 A1 * 6/2014 Chen ..... E06B 9/42 16/400
2015/0136892 A1 * 5/2015 Hung ..... E06B 9/322 242/397.5
2015/0300086 A1 * 10/2015 Chen ..... E06B 9/42 160/317
2016/0130863 A1 * 5/2016 Cheng ..... E06B 9/40 160/179
2016/0348428 A1 * 12/2016 Cheng ..... E06B 9/40
2017/0260804 A1 * 9/2017 Wu ..... E06B 9/322
2017/0350188 A1 * 12/2017 Huang ..... E06B 9/60
2017/0356242 A1 * 12/2017 Lin ..... E06B 9/44
2018/0106101 A1 * 4/2018 Holt ..... E06B 9/42
2019/0010756 A1 * 1/2019 Lin ..... E06B 9/323
2019/0017321 A1 * 1/2019 Chen ..... E06B 9/68
2019/0100960 A1 * 4/2019 Chen ..... E06B 9/34
2019/0257149 A1 * 8/2019 Lei ..... E06B 9/42

* cited by examiner

CORDLESS ROLLER SHADE

BACKGROUND OF THE INVENTION

1. Field of the Invention

The present invention relates to a roller shade and, more particularly, to a cordless roller shade.

2. Description of the Related Art

A conventional roller shade is controlled by a pull cord. When one end of the pull cord is pulled, the roller shade is extended downward, and when the other end of the pull cord is pulled, the roller shade is wound upward. Another conventional roller shade comprises a return mechanism. When the roller shade is pulled downward to a determined position, the return mechanism stores a restoring force, and when the roller shade is wound upward, the roller shade is rolled quickly by the restoring force of the return mechanism. A conventional cordless roller shade comprises a winding mechanism having a shaft and a shade cloth having an upper end secured to the shaft of the winding mechanism. When the winding mechanism is operated, the shaft of the winding mechanism is rotated to move the shade cloth upward or downward so as to wind or unwind the shade cloth. Thus, the shade cloth is wound or unwound by operation of the winding mechanism without needing a pull cord so that the conventional roller shade is operated safely and conveniently.

BRIEF SUMMARY OF THE INVENTION

In accordance with the present invention, there is provided a cordless roller shade comprising a head unit, a shading face mounted on the head unit, an elastic dynamic device mounted on the head unit, and a bottom unit mounted on the shading face. The head unit includes a transverse rod and two side brackets mounted on two opposite ends of the transverse rod. The shading face has an upper end provided with an upper connecting portion wound around the transverse rod of the head unit and a lower end provided with a lower connecting portion. The elastic dynamic device is mounted on one of the two side brackets and includes a housing having an interior provided with a receiving space, two shafts mounted in the receiving space of the housing, two wheels rotatably mounted on the two shafts, a fitting member mounted on one of the two wheels and secured to the transverse rod, a spring mounted between the two shafts and wound around the two wheels, and a cover mounted on the housing and provided with a through hole allowing passage of the fitting member. The spring has a thickness ranged between 0.1 mm and 0.2 mm. The bottom unit is mounted on the lower connecting portion of the shading face and includes a mounting tube having an interior provided with a receiving chamber, two end caps mounted on two ends of the mounting tube, and at least one balance member mounted in the receiving chamber of the mounting tube. The at least one balance member has a determined weight ranged between 0.1 kg and 1.2 kg, and the shading face and the bottom unit have a total weight ranged between 1 kg and 5 kg, to balance a torque of the spring of the elastic dynamic device, so that the shading face is moved by the bottom unit to a determined position and is located at the determined position.

According to the primary advantage of the present invention, the whole weight of the shading face and the bottom unit balances the torque of the spring, so that the shading face is extended by the bottom unit to any determined position and is located at the determined position, thereby facilitating the user adjusting the height of the bottom unit or the length of the shading face.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
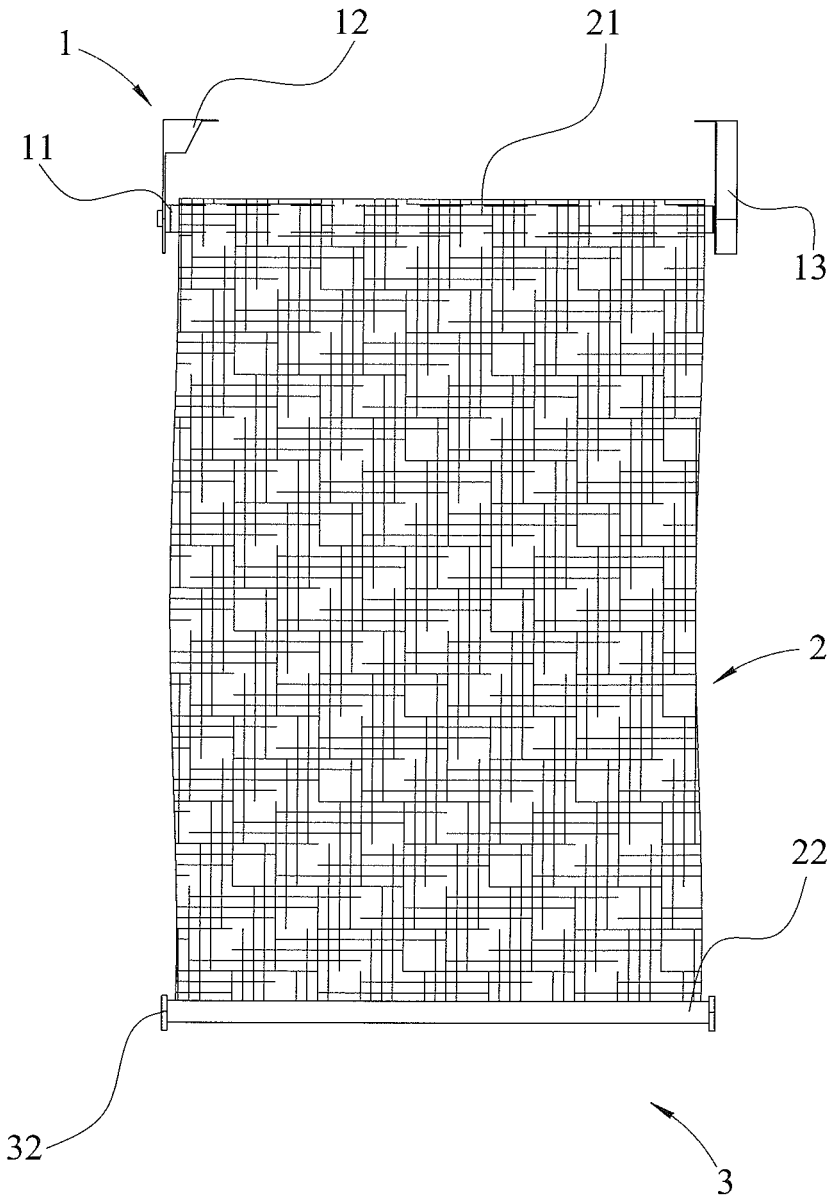
FIG. 1 is a front view of a cordless roller shade in accordance with the preferred embodiment of the present invention.

Referring to the drawings and initially to FIGS. 1-5, a cordless roller shade in accordance with the preferred embodiment of the present invention comprises a head unit 1, a shading face 2 mounted on the head unit 1, an elastic dynamic device 13 mounted on the head unit 1, and a bottom unit 3 mounted on the shading face 2.

The head unit 1 includes a transverse rod 11 and two side brackets 12 mounted on two opposite ends of the transverse rod 11 and attached to a wall.

The shading face 2 has an upper end provided with an upper connecting portion 21 wound around the transverse rod 11 of the head unit 1 and a lower end provided with a lower connecting portion 22.

The elastic dynamic device 13 is mounted on one of the two side brackets 12 and includes a housing 131 having an interior provided with a receiving space 1311, two shafts 1312 mounted in the receiving space 1311 of the housing 131, two wheels 132 rotatably mounted on the two shafts 1312, a fitting member 1321 mounted on one of the two wheels 132 and secured to the transverse rod 11, a spring 133 mounted between the two shafts 1312 and wound around the two wheels 132 in a substantially S-shaped manner to produce a reverse torque by rotation when the shading face 2 is extended downward, and a cover 134 mounted on the housing 131 and provided with a through hole 1341 allowing passage of the fitting member 1321. The two shafts 1312 are parallel with each other. Preferably, each of the two shafts 1312 is a fixed shaft or a rotation shaft. The spring 133 has a thickness ranged between 0.1 mm and 0.2 mm to produce a determined torque. Preferably, the spring 133 is a spiral elastic plate, a volute spiral blade spring or a constant force spring.

The bottom unit 3 is mounted on the lower connecting portion 22 of the shading face 2 and includes a mounting tube 31 having an interior provided with a receiving chamber 310, two end caps 32 mounted on two ends of the mounting tube 31 to close the receiving chamber 310, and at least one balance member 33 mounted in the receiving chamber 310 of the mounting tube 31. The at least one balance member 33 has a determined weight ranged between 0.1 kg and 1.2 kg, to correspond to the shading face 2 of different weight. In such a manner, the shading face 2 and the bottom unit 3 have a total weight ranged between 1 kg and 5 kg, to balance the torque of the spring 133 of the elastic dynamic device 13, so that the shading face 2 is moved by the bottom unit 3 to a determined position and is located at the determined position.

In the preferred embodiment of the present invention, the cordless roller shade further comprises a retainer 4 secured to the transverse rod 11 of the head unit 1 and detachably mounted on the other one of the two side brackets 12. The retainer 4 includes a casing 41 having a first end provided with an opening 411 and a second end provided with a pivot hole 412, a stop knob 42 mounted in the casing 41 and having an end extending through and protruding from the pivot hole 412 of the casing 41, a lid 44 mounted in the opening 411 of the casing 41, and an elastic member 43 mounted in the casing 41 and biased between the stop knob 42 and the lid 44 to push the stop knob 42 to protrude from the pivot hole 412 of the casing 41.

In the preferred embodiment of the present invention, the mounting tube 31 of the bottom unit 3 has a circular shape, an oblong shape or a polygonal shape.

In the preferred embodiment of the present invention, the at least one balance member 33 is received in the receiving chamber 310 of the mounting tube 31. Alternatively, the at least one balance member 33 is located outside of the mounting tube 31 of the bottom unit 3 in a clamping manner.

Figure 2:
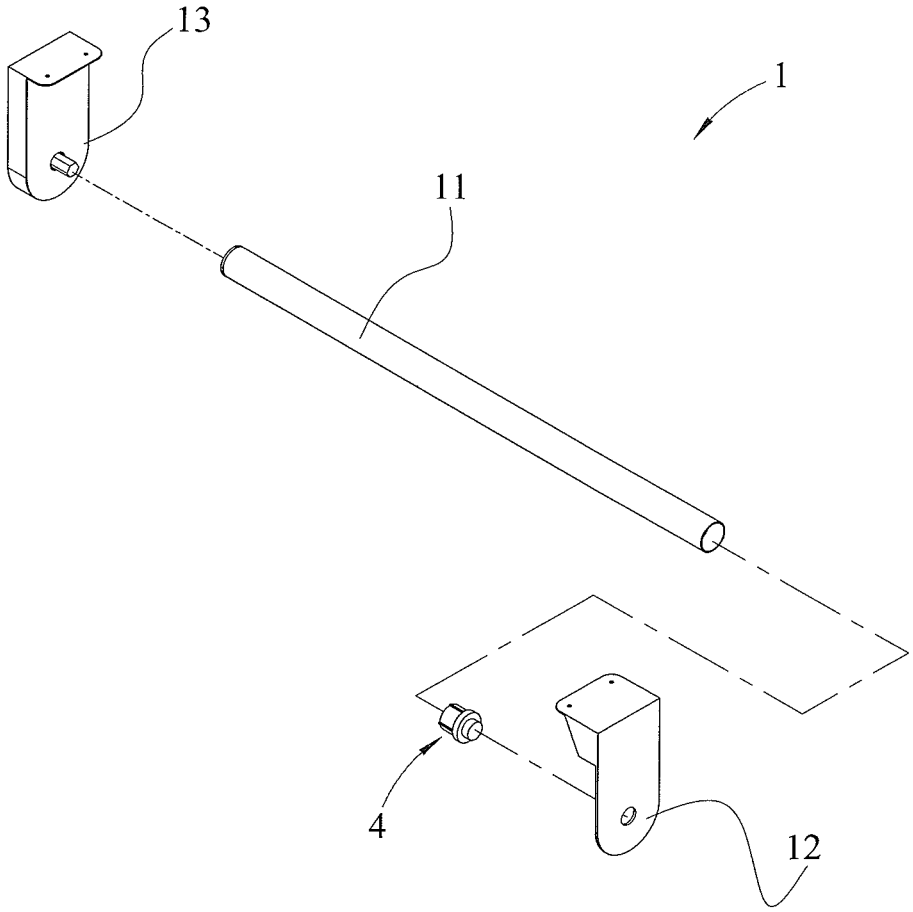
FIG. 2 is a partially exploded perspective view of a head unit of the cordless roller shade as shown in FIG. 1.
Figure 3:
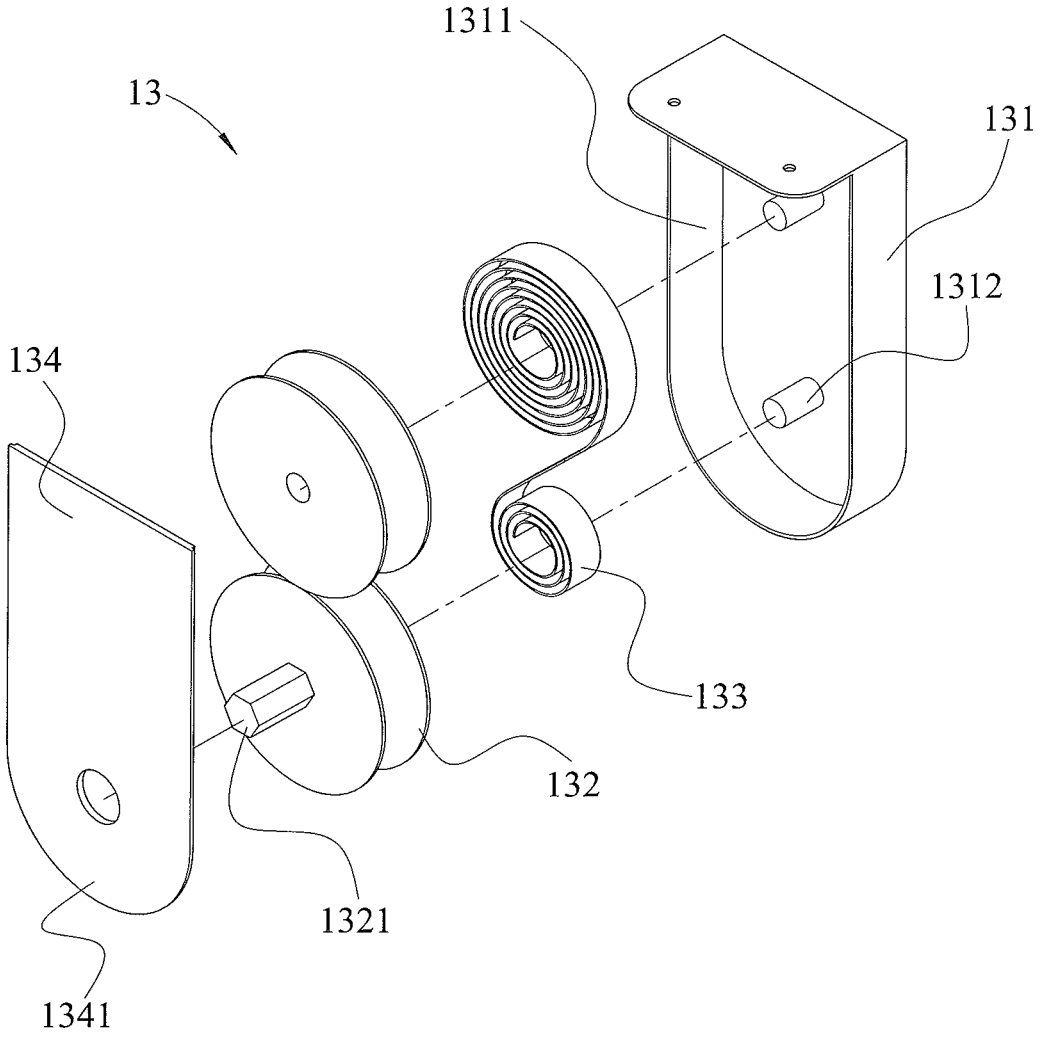
FIG. 3 is an exploded perspective view of an elastic dynamic device of the cordless roller shade as shown in FIG. 1.
Figure 4:
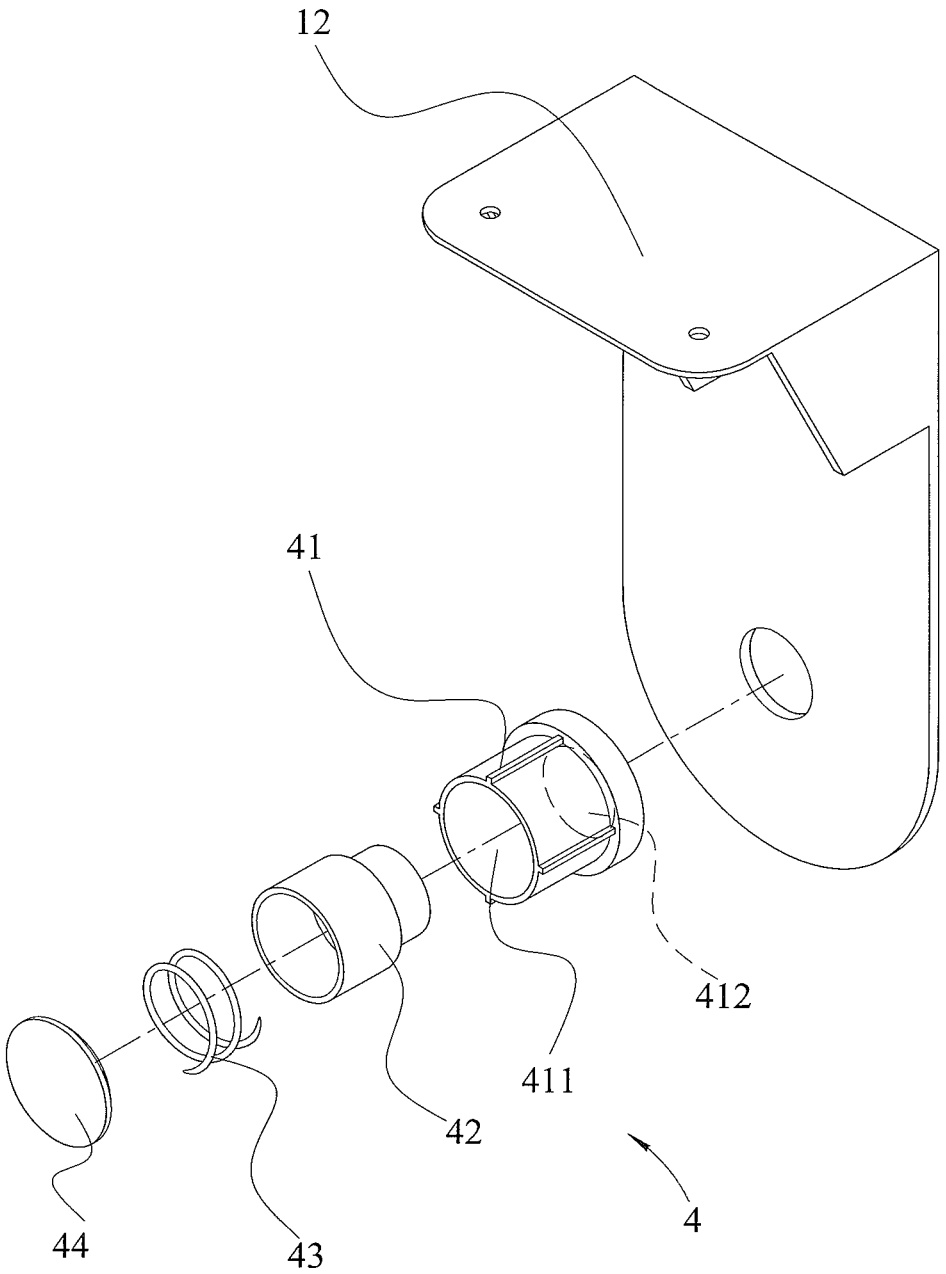
FIG. 4 is an exploded perspective view of a retainer of the cordless roller shade as shown in FIG. 1.
Figure 5:
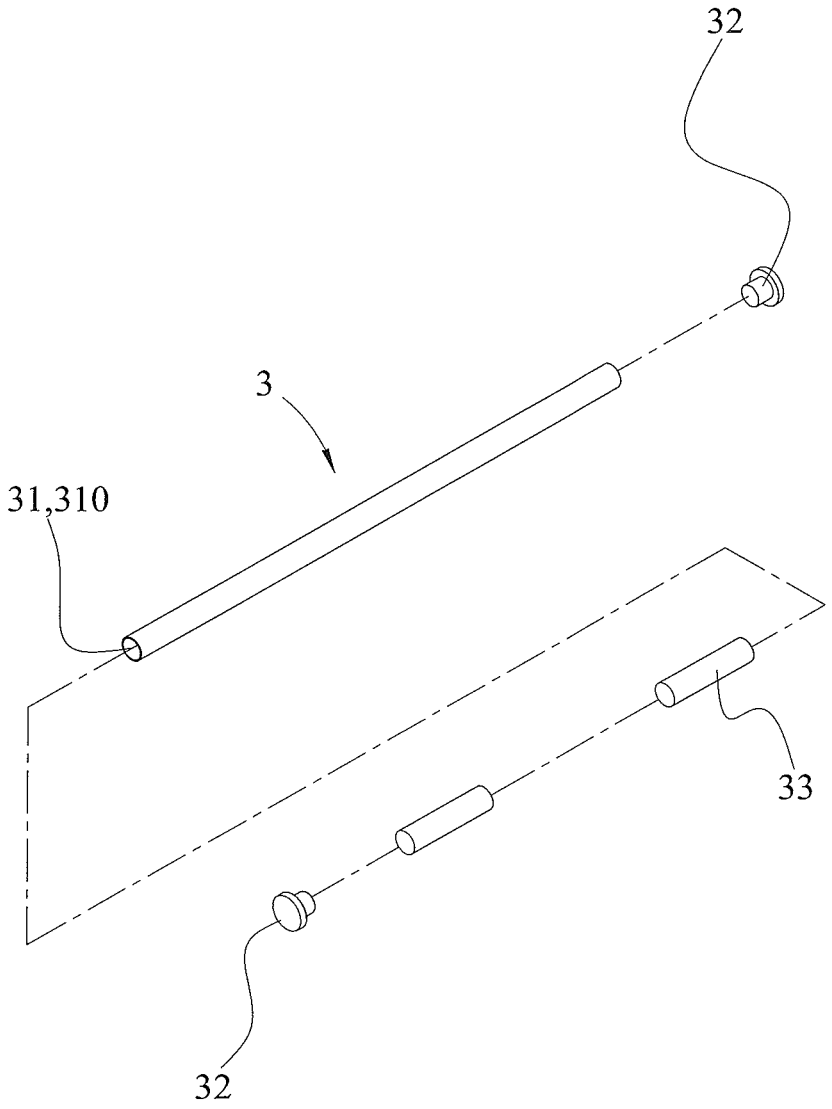
FIG. 5 is a partially exploded perspective view of a bottom unit of the cordless roller shade as shown in FIG. 1.
Figure 6:
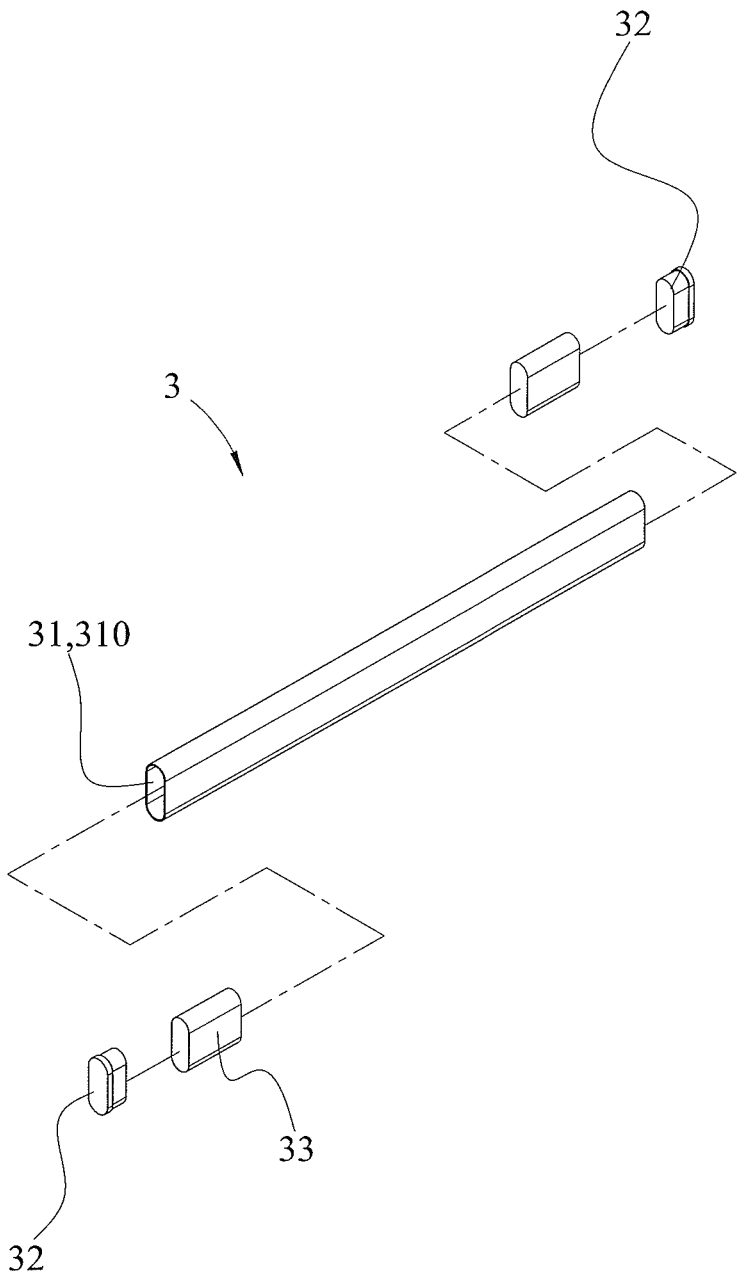
FIG. 6 is a partially exploded perspective view of a bottom unit of the cordless roller shade in accordance with a first preferred embodiment of the present invention.
Figure 7:
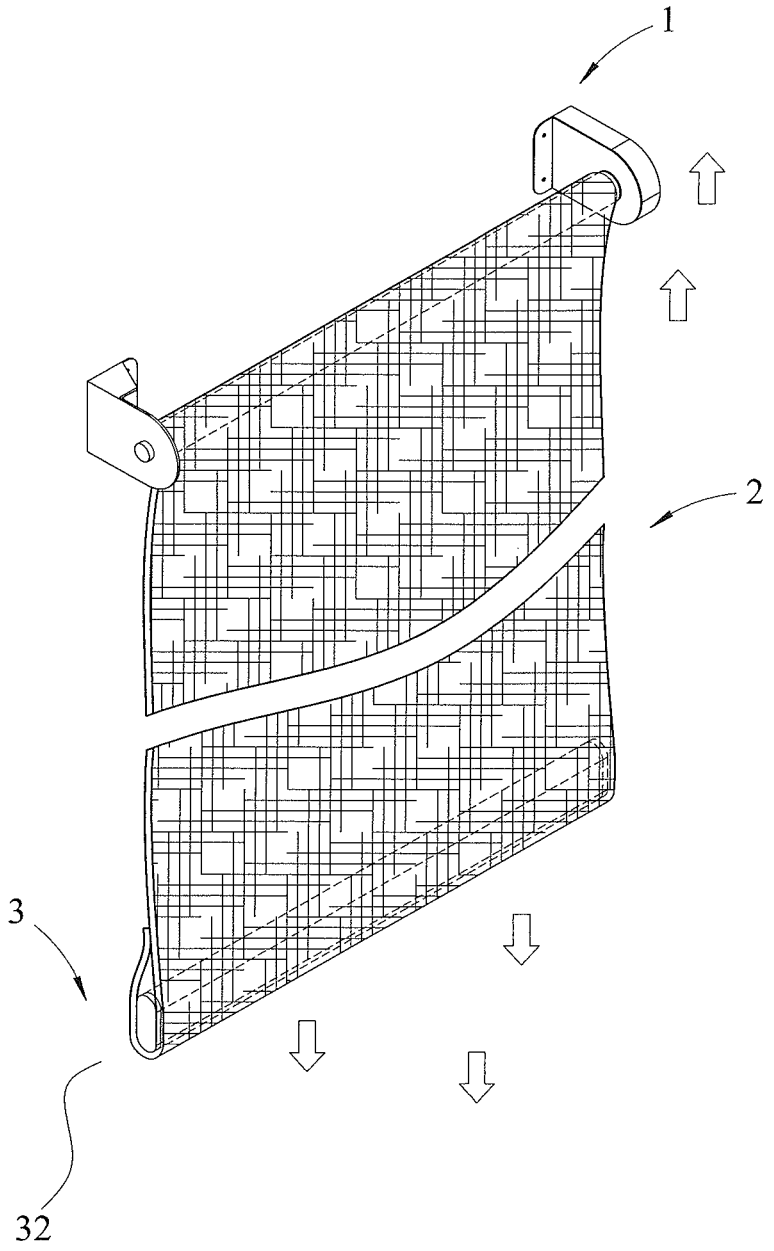
FIG. 7 is a schematic operational view of the cordless roller shade with the first preferred embodiment of the present invention.

Referring to FIGS. 6 and 7 with reference to FIGS. 2-4, the bottom unit 3 includes two balance members 33 mounted in the receiving chamber 310 of the mounting tube 31. The lower connecting portion 22 of the shading face 2 is curled upward and forms a loop by stitching, and the bottom unit 3 extends through the lower connecting portion 22 of the shading face 2. Thus, the bottom unit 3 is hidden in the lower connecting portion 22 of the shading face 2 and is not exposed outward from the shading face 2 to enhance the appearance of the shading face 2. The shading face 2 is moved upward and downward by the bottom unit 3 and is located at the determined position.

Figure 8:
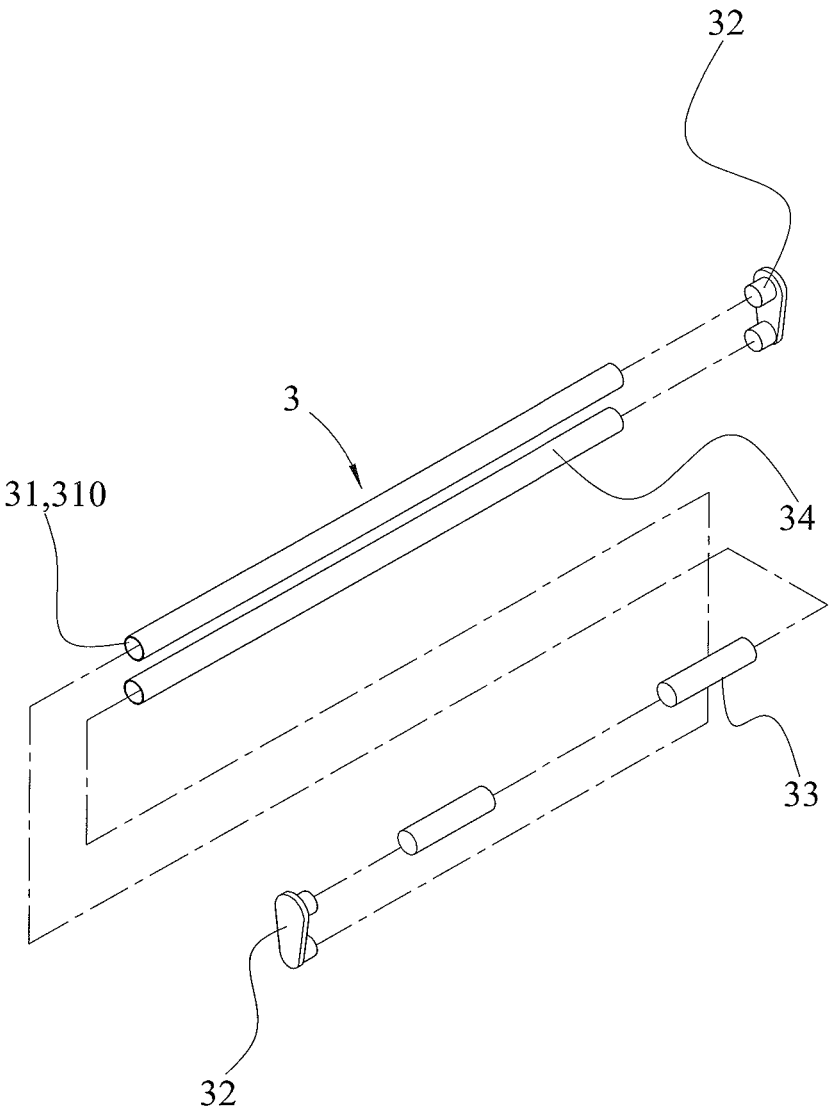
FIG. 8 is a partially exploded perspective view of a bottom unit of the cordless roller shade in accordance with a second preferred embodiment of the present invention.
Figure 9:
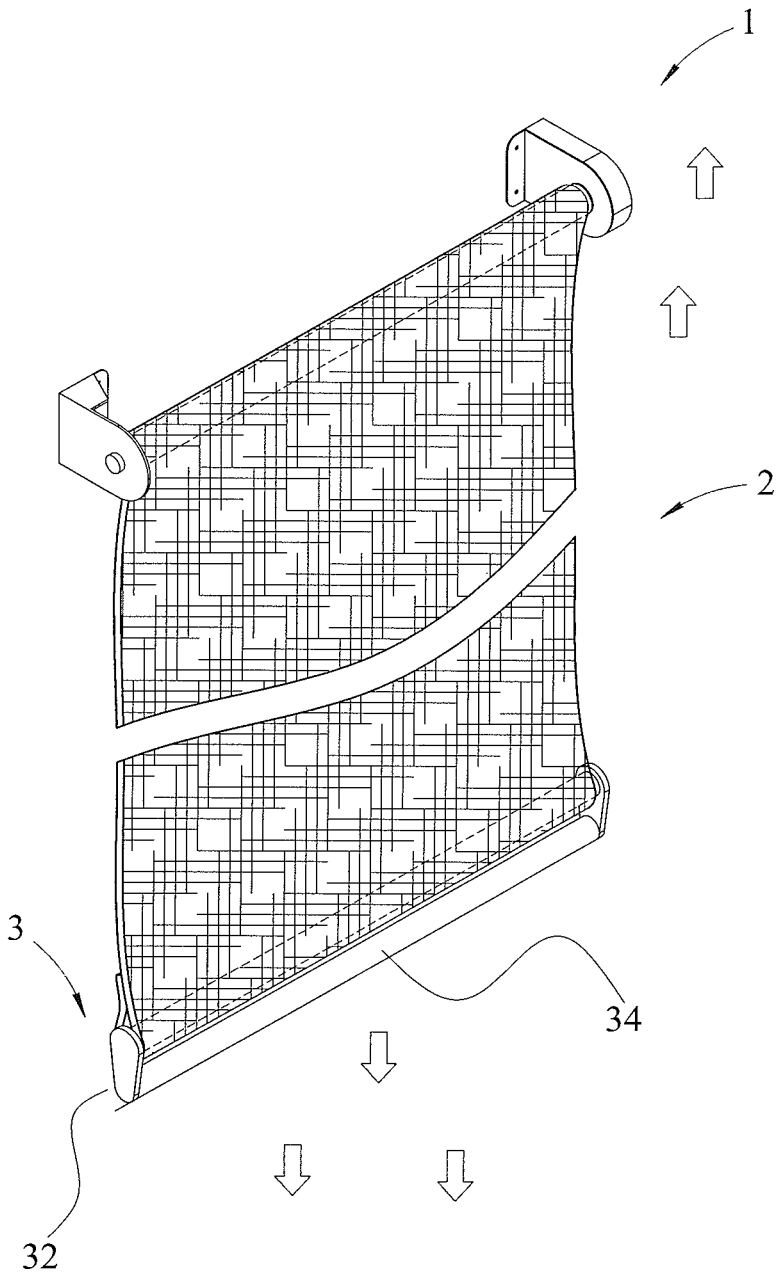
FIG. 9 is a schematic operational view of the cordless roller shade with the second preferred embodiment of the present invention.

Referring to FIGS. 8 and 9 with reference to FIGS. 2-4, the bottom unit 3 further includes a drawing member 34 mounted on the mounting tube 31 to facilitate a user adjusting the height of the bottom unit 3. The drawing member 34 is located under the mounting tube 31 and is connected with the mounting tube 31 by the two end caps 32. The drawing member 34 has a rod shape and has a length equal to that of the mounting tube 31.

Figure 10:
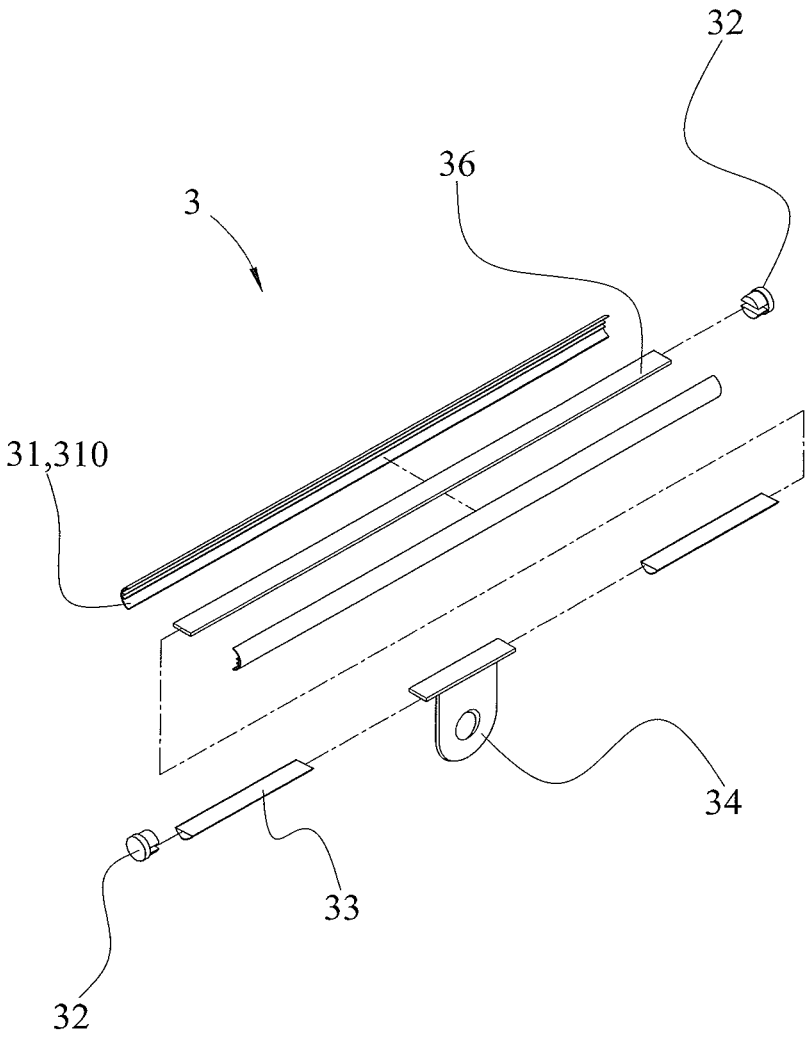
FIG. 10 is an exploded perspective view of a bottom unit of the cordless roller shade in accordance with a third preferred embodiment of the present invention.
Figure 11:
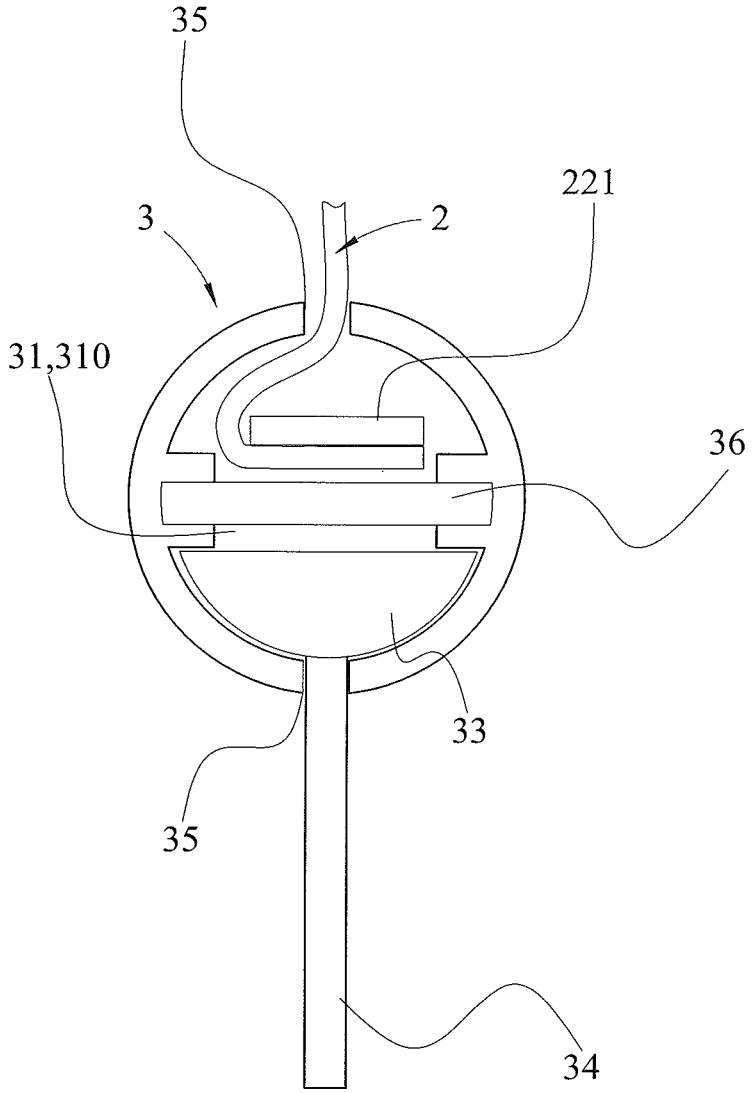
FIG. 11 is a side view of the cordless roller shade in accordance with the third preferred embodiment of the present invention.
Figure 12:
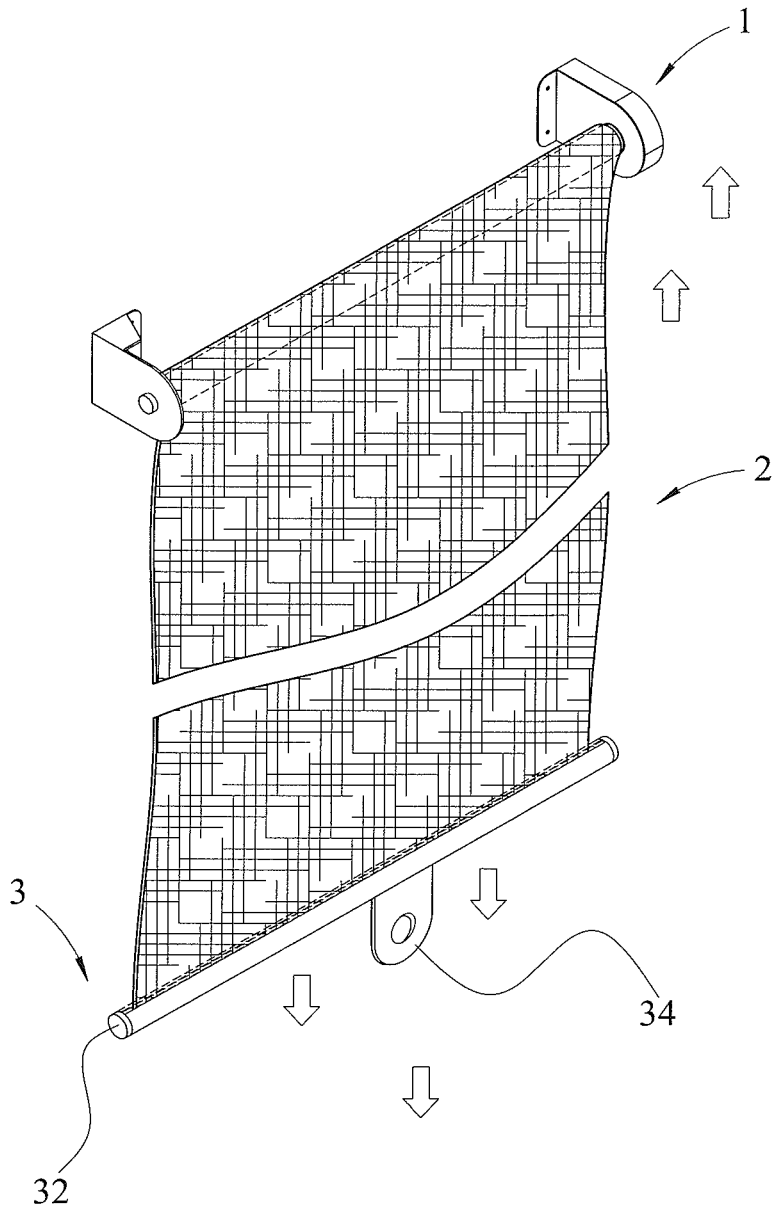
FIG. 12 is a schematic operational view of the cordless roller shade with the third preferred embodiment of the present invention.

Referring to FIGS. 10-12 with reference to FIGS. 2-4, the bottom unit 3 further includes a partition 36 mounted in the mounting tube 31 and dividing the receiving chamber 310 of the mounting tube 31 into an upper zone and a lower zone. The mounting tube 31 of the bottom unit 3 has a top and bottom each provided with a passage 35 connected to the receiving chamber 310. The shading face 2 extends through the passage 35 of the top of the mounting tube 31 into the upper zone of the receiving chamber 310. The drawing member 34 is preferably a pull tab. The drawing member 34 is mounted in the lower zone of the receiving chamber 310 and protrudes from the passage 35 of the bottom of the mounting tube 31.

In the preferred embodiment of the present invention, the lower connecting portion 22 of the shading face 2 is provided with a fixed member 221 by stitching. The fixed member 221 of the shading face 2 extends through the receiving chamber 310 of the bottom unit 3, and the lower connecting portion 22 of the shading face 2 extends through the passage 35 of the top of the mounting tube 31.

In operation, when the bottom unit 3 is pulled downward, the shading face 2 is extended downward by the bottom unit 3, and the transverse rod 11 of the head unit 1 is rotated to rotate the fitting member 1321 which rotates one of the two wheels 132, so that the spring 133 of the elastic dynamic device 13 at one of the two wheels 132 is revolved and twisted to store a determined torque or restoring force. At this time, the at least one balance member 33 of the bottom unit 3 has a determined weight to balance the torque of the spring 133 of the elastic dynamic device 13. When the shading face 2 is extended downward gradually, the spring 133 of the elastic dynamic device 13 is twisted gradually to store a larger torque. At this time, the shading face 2 is extended outward from the transverse rod 11 of the head unit 1 to increase the whole weight, and the whole weight of the extended shading face 2 and the bottom unit 3 balances the torque of the spring 133, so that the shading face 2 is extended by the bottom unit 3 to any determined position and is located at the determined position. When the bottom unit 3 is pushed upward, the shading face 2 is wound upward by release of the torque of the spring 133 and is rewound around the transverse rod 11 of the head unit 1. When the bottom unit 3 is located at a higher position, a tool is hooked on the drawing member 34 to move the bottom unit 3.

Accordingly, the whole weight of the shading face 2 and the bottom unit 3 balances the torque of the spring 133, so that the shading face 2 is extended by the bottom unit 3 to any determined position and is located at the determined position, thereby facilitating the user adjusting the height of the bottom unit 3 or the length of the shading face 2.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A cordless roller shade comprising:

a head unit (1);

a shading face (2) mounted on the head unit;

an elastic dynamic device (13) mounted on the head unit; and a bottom unit (3) mounted on the shading face;

wherein:

the head unit includes a transverse rod (11) and two side brackets (12) mounted on two opposite ends of the transverse rod;

the shading face has an upper end provided with an upper connecting portion (21) wound around the transverse rod of the head unit and a lower end provided with a lower connecting portion (22);

the elastic dynamic device is mounted on one of the two side brackets and includes:

a housing (131) having an interior provided with a receiving space (1311);

two shafts (1312) mounted in the receiving space of the housing;

two wheels (132) rotatably mounted on the two shafts;

a fitting member (1321) mounted on one of the two wheels and secured to the transverse rod;

a spring (133) mounted between the two shafts and wound around the two wheels; and a cover (134) mounted on the housing and provided with a through hole (1341) allowing passage of the fitting member;

the spring has a thickness ranged between 0.1 mm and 0.2 mm;

the bottom unit is mounted on the lower connecting portion of the shading face and includes:

a mounting tube (31) having an interior provided with a receiving chamber (310);

two end caps (32) mounted on two ends of the mounting tube; and at least one balance member (33) mounted in the receiving chamber of the mounting tube;

the at least one balance member has a determined weight ranged between 0.1 kg and 1.2 kg;

the shading face and the bottom unit have a total weight ranged between 1 kg and 5 kg, to balance a torque of the spring of the elastic dynamic device, so that the shading face is moved by the bottom unit to a determined position and is located at the determined position;

the cordless roller shade further comprises a retainer (4) secured to the transverse rod of the head unit and detachably mounted on the other one of the two side brackets;

the retainer includes:

a casing (41) having a first end provided with an opening (411) and a second end provided with a pivot hole (412);

a stop knob (42) mounted in the casing and having an end extending through and protruding from the pivot hole of the casing;

a lid (44) mounted in the opening of the casing; and an elastic member (43) mounted in the casing and biased between the stop knob and the lid to push the stop knob to protrude from the pivot hole of the casing.

2. The cordless roller shade of claim 1, wherein the mounting tube of the bottom unit has a circular shape, an oblong shape or a polygonal shape.

3. The cordless roller shade of claim 1, wherein the bottom unit further includes a drawing member (34) mounted on the mounting tube.

4. The cordless roller shade of claim 3, wherein:

the bottom unit further includes a partition (36) mounted in the mounting tube and dividing the receiving chamber of the mounting tube into an upper zone and a lower zone; and the mounting tube of the bottom unit has a top and bottom each provided with a passage (35) connected to the receiving chamber.

5. The cordless roller shade of claim 4, wherein:

the lower connecting portion of the shading face is provided with a fixed member (221) by stitching;

the fixed member of the shading face extends through the receiving chamber of the bottom unit; and the lower connecting portion of the shading face extends through the passage of the top of the mounting tube.

6. The cordless roller shade of claim 1, wherein the lower connecting portion of the shading face is curled upward and forms a loop by stitching, and the bottom unit extends through the lower connecting portion of the shading face.

7. The cordless roller shade of claim 1, wherein the lower connecting portion of the shading face is located under the upper connecting portion of the shading face.

8. The cordless roller shade of claim 1, wherein the lower connecting portion of the shading face is secured to the bottom unit.

9. The cordless roller shade of claim 1, wherein the lower connecting portion of the shading face is moved in concert with movement of the bottom unit.

10. The cordless roller shade of claim 1, wherein the lower connecting portion of the shading face is moved in concert with movement of the shading face.

11. The cordless roller shade of claim 1, wherein the mounting tube of the bottom unit is located between the shading face and the at least one balance member of the bottom unit, with the shading face being separated from the at least one balance member.

12. The cordless roller shade of claim 1, wherein the thickness of the spring corresponds to the total weight of the shading face and the bottom unit, to balance the torque of the spring with the total weight of the shading face and the bottom unit, such that the shading face is moved to and kept at any position.

13. The cordless roller shade of claim 1, wherein the elastic member presses the stop knob.

14. The cordless roller shade of claim 1, wherein the stop knob is movable in the casing.

* * * * *